US009120594B2

(12) United States Patent
Huang et al.

(10) Patent No.: US 9,120,594 B2
(45) Date of Patent: Sep. 1, 2015

(54) HEXAGONAL COMBINATION STORAGE BOX

(71) Applicant: USUN TECHNOLOGY CO., LTD., Taoyuan (TW)

(72) Inventors: Chiu-Fong Huang, Taoyuan (TW); Chin-Te Chang, Taoyuan (TW)

(73) Assignee: Usun Technology Co., Ltd., Taoyuan (TW)

( * ) Notice: Subject to any disclaimer, the term of this patent is extended or adjusted under 35 U.S.C. 154(b) by 80 days.

(21) Appl. No.: 14/135,972

(22) Filed: Dec. 20, 2013

(65) Prior Publication Data

US 2015/0175299 A1 Jun. 25, 2015

(51) Int. Cl.
*B65D 6/18* (2006.01)
*B65D 6/24* (2006.01)

(52) U.S. Cl.
CPC ..... *B65D 11/1833* (2013.01); *B65D 11/1846* (2013.01); *B65D 11/1873* (2013.01)

(58) Field of Classification Search
CPC ..... B65D 11/1833; B65D 11/1846; B65D 11/1873; B65D 2519/00502; B65D 11/18
USPC ..... 220/4.28, 4.29, 6; 211/74, 186, 182
See application file for complete search history.

(56) References Cited

U.S. PATENT DOCUMENTS

| | | | | |
|---|---|---|---|---|
| 2,490,296 | A * | 12/1949 | Fournier | 5/99.1 |
| 4,453,665 | A * | 6/1984 | Roccaforte et al. | 229/108.1 |
| 4,678,095 | A * | 7/1987 | Barnett et al. | 220/4.21 |
| 5,971,263 | A * | 10/1999 | Mangano | 229/110 |
| 8,511,497 | B2 * | 8/2013 | Foster, Sr. | 220/6 |
| 9,016,485 | B1 * | 4/2015 | Liu | 211/189 |

* cited by examiner

*Primary Examiner* — Stephen Castellano
(74) *Attorney, Agent, or Firm* — Rosenberg, Klein & Lee

(57) ABSTRACT

A hexagonal combination storage box includes two pieces of trapezoidal base panels each including first and second connection structures respectively located at two opposing parallel sides thereof and locating notches respectively located at two opposing lateral sides thereof, the first connection structure of one base panel being pivotally connected to the first connection structure of the other base panel, and six pieces of rectangular peripheral panels each including a first coupling structure located at one short side thereof and pivotally connected to the second connection structure of one base panel or engaged into the locating notches of one base panel, two mating second coupling structures respectively located at the two parallel long sides thereof so designed that one second coupling structure of one peripheral panel is pivotally connectable to the other second coupling structure of another peripheral panel.

8 Claims, 10 Drawing Sheets

HEXAGONAL COMBINATION STORAGE BOX

BACKGROUND OF THE INVENTION

1. Field of the Invention

The present invention relates to combination storage box design, and more particularly, to a hexagonal combination storage box, which consists of two pieces of trapezoidal base panels and six pieces of rectangular peripheral panels that are pivotally connectable to one another. Further, hook means, recessed portions and lugs are provided at an outer surface of each peripheral panel and so arranged that multiple assembled combination storage boxes can be secured to one another to establish a combination honeycomb storage box assembly.

2. Description of the Related Art

Storage boxes, storage cabinets, exhibition racks, clothes racks, shoe racks, book racks, toy racks and many other storage containers may be used in bedrooms, kitchens, offices, sales centers and many other places for storing different assorted storage items for quick access to storage items, or for holding commercial items for exhibition.

Various combination storage boxes are commercially available and widely invited by consumers for the advantages of high detachability, easy DIY and delivery convenience. Commercial combination storage boxes are commonly composed of different shapes of plate members made of wood, plastics or metal, and fastening members, for example, screws for fastening the plate members together. These commercial combination storage boxes have the common drawbacks of limited application range and complicated mounting and dismounting procedures. Further, when mounting or dismounting a combination storage box, a hand tool must be used. After dismounting of a combination storage box, the component parts are scattered, not convenient for storage, and the components could be lost after dismounting of the combination storage box.

SUMMARY OF THE INVENTION

The present invention has been accomplished under the circumstances in view. It is therefore the main object of the present invention to provide a hexagonal combination storage box, which facilitates quick mass production and quality control, simplifies the assembly process, and saves much the installation time and labor costs To achieve this and other objects of the present invention, a hexagonal combination storage box of the invention comprises two pieces of base panels pivotally coupled together, and six pieces of peripheral panels pivotally coupled to one another and pivotally coupled of the base panels. The base panels are trapezoidal panels with two parallel sides of different lengths and two non-parallel lateral sides of equal length. Further, each base panel comprises a first connection structure located at the longer parallel side thereof and a second connection structure located at the shorter parallel side thereof. The first connection structure of one base panel is pivotally connectable to the first connection structure of the other base panel. The peripheral panels are rectangular panels with two parallel short sides and two parallel long sides. Each peripheral panel comprises opposing front and back surfaces, a first coupling structure located at one short side thereof and pivotally connectable to the second connection structure of one base panel, two mating second coupling structures respectively located at the two parallel long sides thereof, a hook structure located on a middle part of the front surface thereof, a plurality of recessed portions located on the front surface thereof at two opposite lateral sides relative to the hook structure and a lug disposed in each recessed portion. The two mating second coupling structures are so designed that one second coupling structure of one peripheral panel is pivotally connectable to the other second coupling structure of another peripheral panel.

Further, the hook structure, recessed portions and lugs of each peripheral panel are so designed that multiple assembled hexagonal combination storage boxes can be arranged together to establish a combination honeycomb storage box assembly by hooking up the hook structure of one peripheral panel of one assembled hexagonal combination storage box with the hook structure of one mating peripheral panel of another hexagonal combination storage box to abut the lugs of the respective peripheral panel of one assembled hexagonal combination storage box against the lugs of the mating peripheral panel of another assembled hexagonal combination storage box.

Preferably, each trapezoidal base panel further comprises a hand hole cut through opposing top and bottom surface thereof. By means of inserting the hands into the hand holes of the two trapezoidal base panels of the assembled hexagonal combination storage box and then lifting the two trapezoidal base panels to have the two trapezoidal base panels be attached to each other, the 6 pcs of rectangular peripheral panels of the assembled hexagonal combination storage box are collapsed with the three pieces of rectangular peripheral panels at one trapezoidal base panel stacked on the three pieces of rectangular peripheral panels at the other trapezoidal base panel in a flat condition.

Preferably, each trapezoidal base panel further comprises a mounting through hole cut through the opposing top and bottom surface thereof for the mounting of a fastening member to affix the respective trapezoidal base panel to an upright wall. Thus, the assembled hexagonal combination storage box can be perpendicularly affixed to an upright wall.

Further, when placing one assembled hexagonal combination storage box horizontally on the floor, the angled hook plates of the hook structure of one peripheral panel and the respective lugs can be stopped at the floor to support the assembled hexagonal combination storage box above the floor, preventing moisture and water damage.

DETAILED DESCRIPTION OF THE PREFERRED EMBODIMENT

Figure 1:
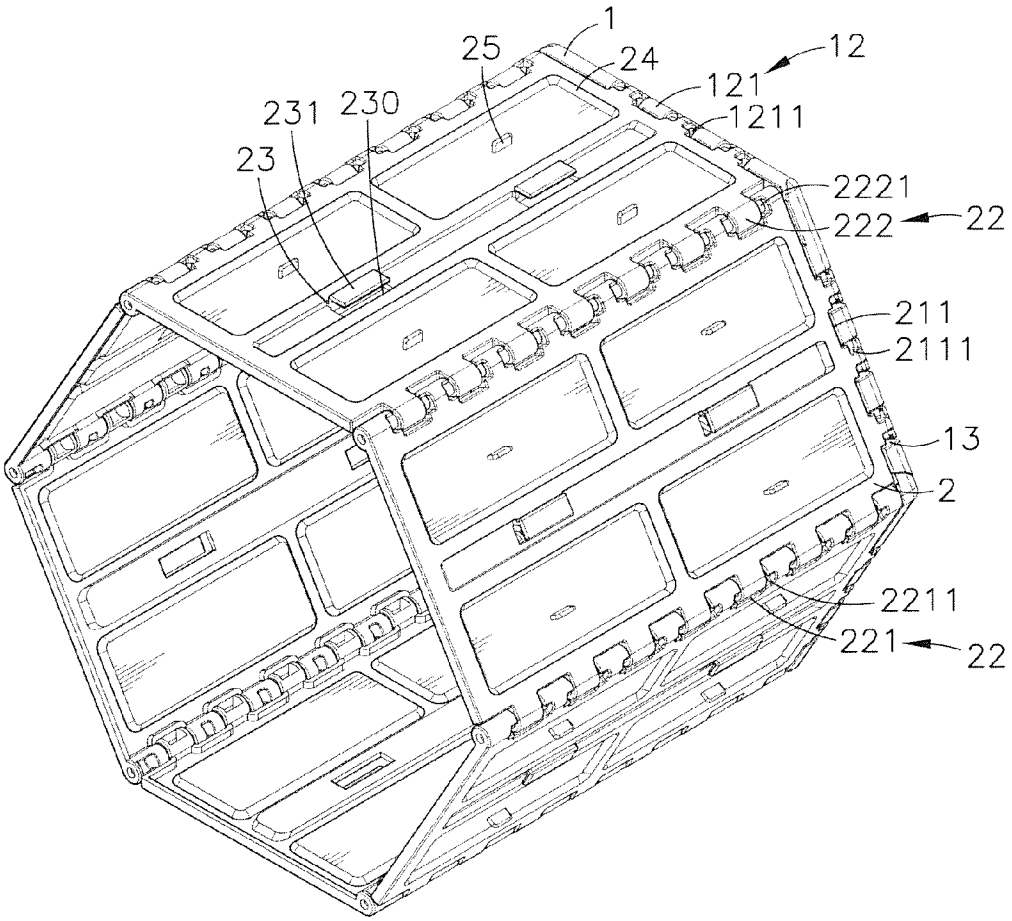
FIG. 1 is an elevational view of an assembled hexagonal combination storage box in accordance with the present invention.
Figure 2:
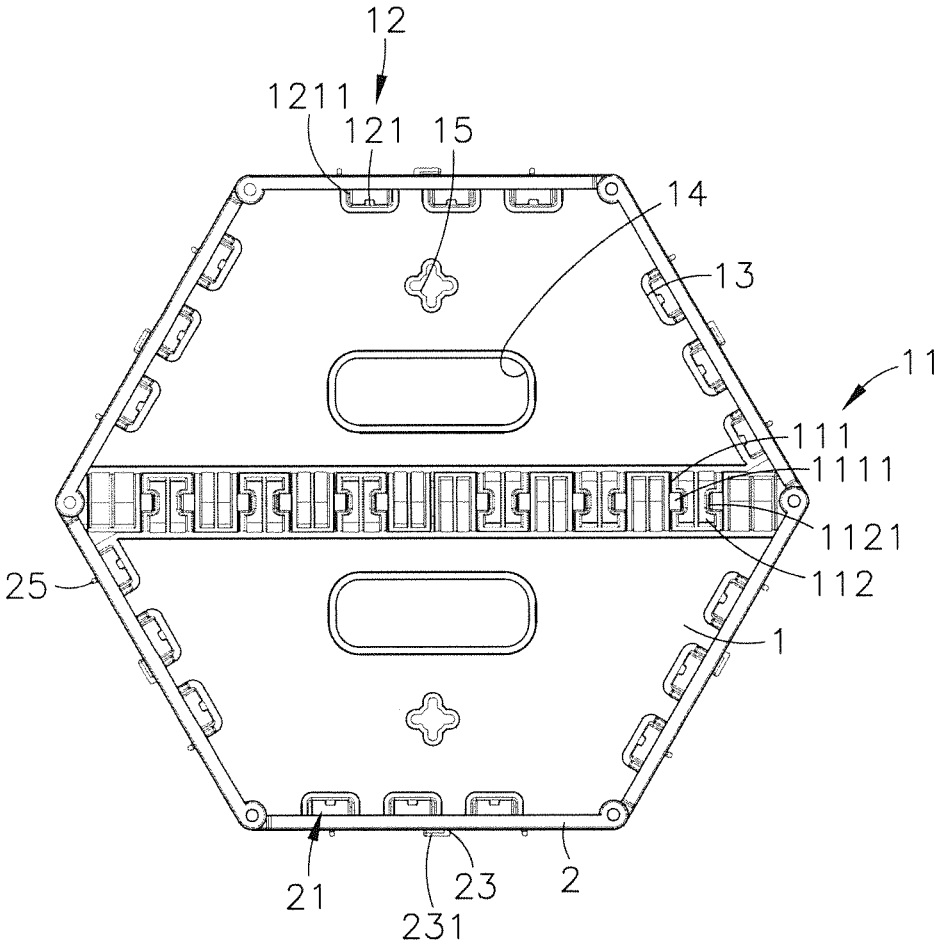
FIG. 2 is a front view of the assembled hexagonal combination storage box shown in FIG. 1.
Figure 3:
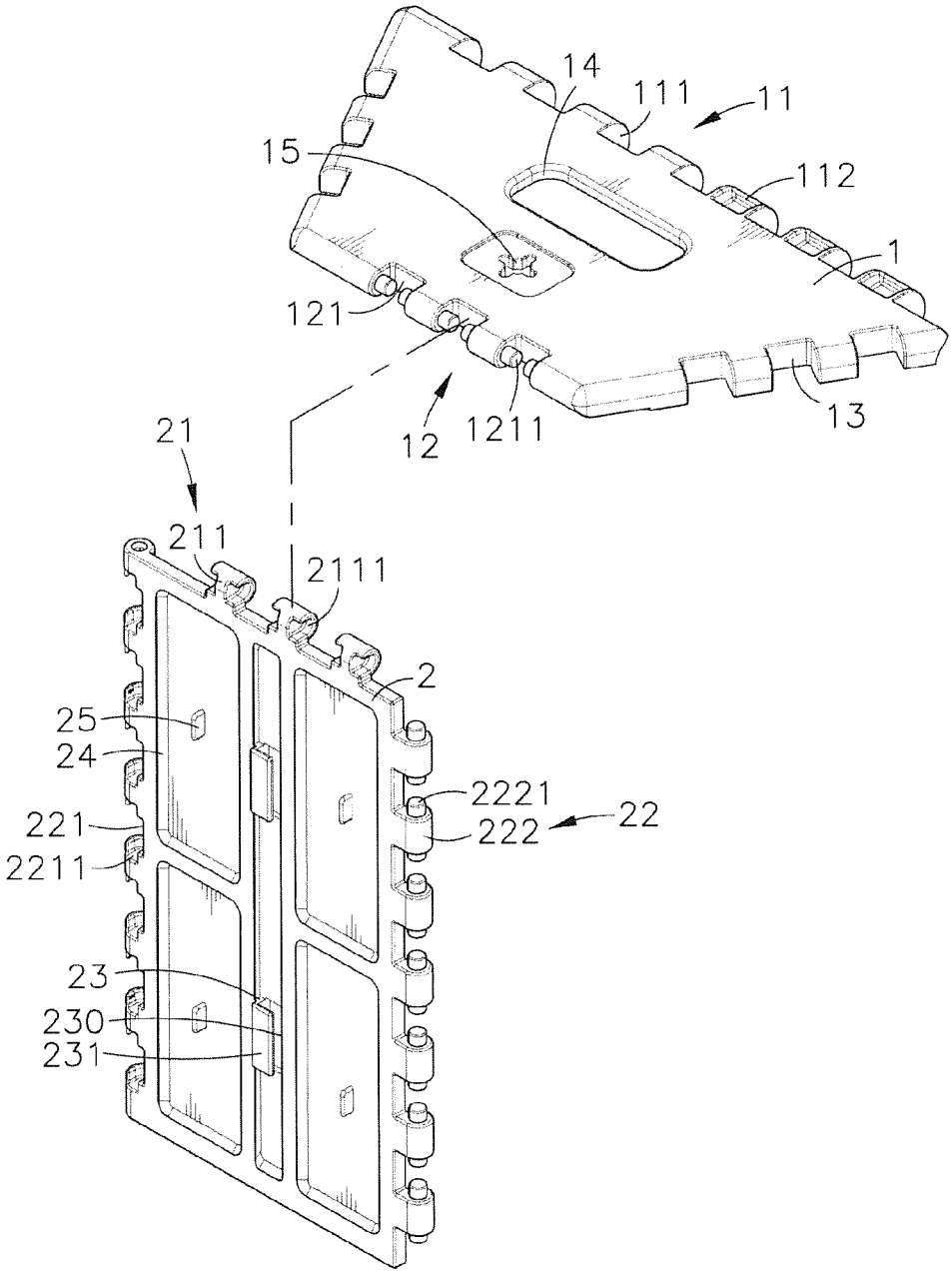
FIG. 3 is an exploded view of one base panel and one peripheral panel in accordance with the present invention.
Figure 4:
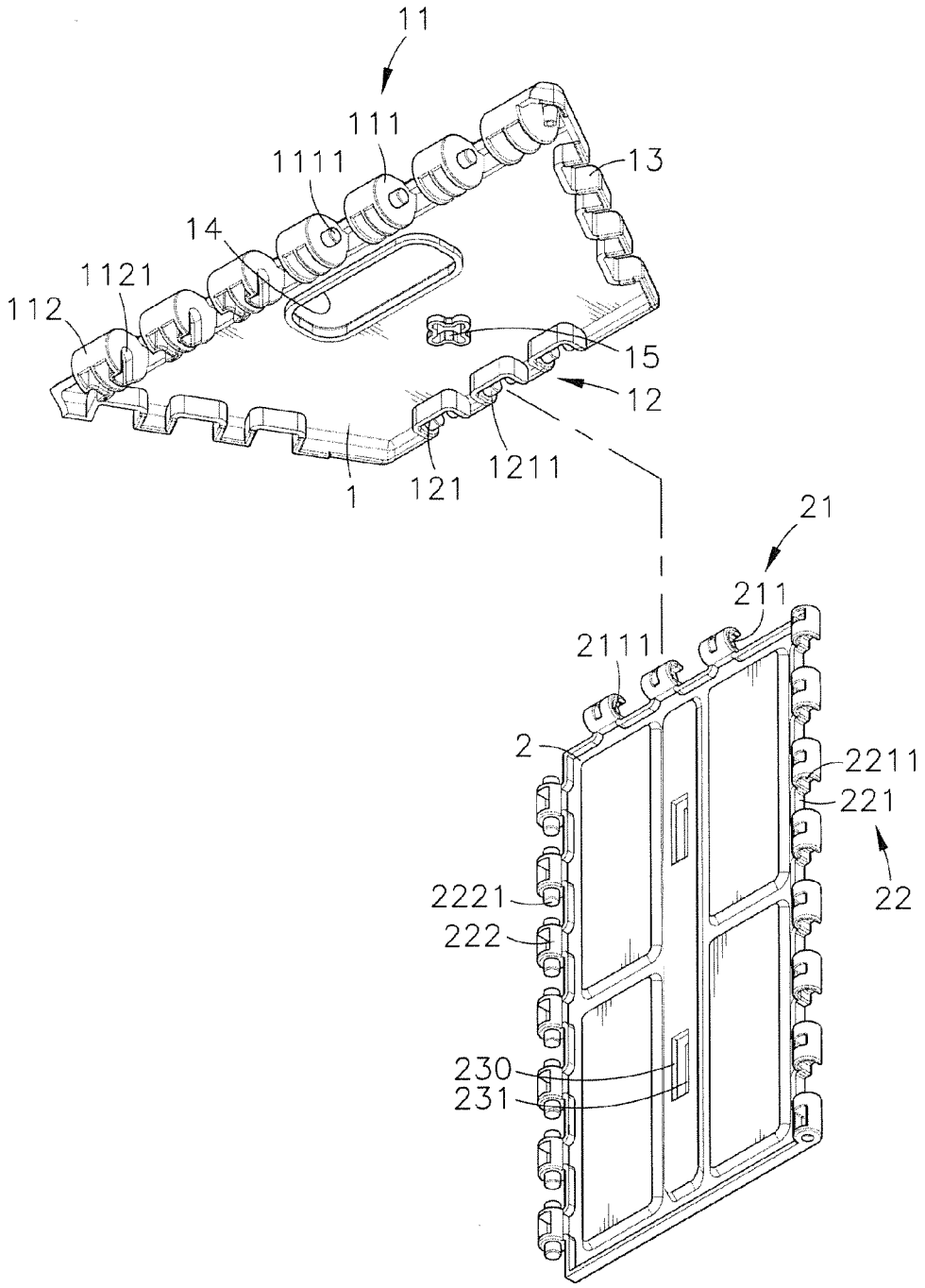
FIG. 4 corresponds to FIG. 3 when viewed from another angle.

Referring to FIGS. 1-4, a hexagonal combination storage box in accordance with the present invention is shown. The hexagonal combination storage box comprises a plurality of base panels 1, and a plurality of peripheral panels 2.

The base panels 1 are trapezoidal panels with two parallel sides (bases) of different lengths and two non-parallel lateral sides (legs) of equal length. Each base panel 1 comprises a first connection structure 11 located at the longer parallel side thereof. The first connection structure 11 comprises a plurality of cylindrical blocks 112 and open spaces 111 alternatively arranged along the length of the longer parallel side of the respective base panel 1, a pivot pin 1111 extended from each of selected cylindrical blocks 112 and suspending in one respective open space 111, and two pivot holes 1121 bilaterally formed in each of the other cylindrical blocks 112 and axially aligned in line.

Each base panel 1 further comprises a second connection structure 12 located at the shorter parallel side thereof, a plurality of locating notches 13 located at and equally spaced along each of the two non-parallel lateral sides thereof, a hand hole 14 cut through opposing top and bottom surfaces thereof and disposed adjacent to the first connection structure 11 thereof, and at least one mounting through hole 15 cut through opposing top and bottom surfaces around the hand hole 14. Further, the second connection structure 12 comprises a plurality of recessed holes 121 equally spaced along the shorter parallel side of the respective base panel 1, and two pivot pins 1211 disposed in each recessed hole 121 at two opposite sides and axially aligned in line The peripheral panels 2 are rectangular panels with two parallel short sides and two parallel long sides. Further, each peripheral panel 2 comprises a first coupling structure 21 located at one short side thereof, and two mating second coupling structures 22 respectively located at the two parallel long sides thereof. The first coupling structure 21 comprises a plurality of equally spaced cylindrical coupling blocks 211 respectively insertable into the recessed holes 121 of the second connection structure 12 of one base panel 1, and two coupling holes 2111 bilaterally defined in each cylindrical coupling block 211 and respectively pivotally coupled to the two pivot pins 1211 in each respective recessed hole 121 of the second connection structure 12 of the respective base panel 1. One second coupling structure 22 of each peripheral panel 2 comprises a plurality of knuckles 2211 and a plurality of mounting grooves 221 alternatively arranged along the length of the respective long side of the respective peripheral panel 2. The other second coupling structure 22 of each peripheral panel 2 comprises a plurality of cylindrical mounting blocks 222 respectively inserted into the mounting grooves 221 of one second coupling structure 22 of another peripheral panel 2, and two pivot pins 2221 respectively and axially extended from two opposite ends of each cylindrical mounting block 222 and respectively pivotally coupled to respective knuckles 2211 of the mating second coupling structure 22 of the mating peripheral panel 2.

Each peripheral panel 2 further comprises a hook structure 23, which comprises, for example, but not limited to, two locating holes 230 cut through opposing front and back surfaces thereof and longitudinally spaced on a middle part thereof and two angled hook plates 231 respectively disposed adjacent to the locating holes 230, at least one, for example, four recessed portions 24 located on the front surface thereof and respectively disposed at two opposite lateral sides relative to the locating holes 230, and a plurality of lugs 25 respectively located on the recessed portions 24.

According to the present invention, 2 pcs of base panels 1 can be assembled with 6 pcs of peripheral panels 2 to build up a hexagonal combination storage box. This assembly procedure is outlined hereinafter. At first, couple the first connection structure 11 of one base panel 1 to the first connection structure 11 of the other base panel 1 by inserting the cylindrical blocks 112 of one base panel 1 into the open spaces 111 of the other base panel 1 to pivotally couple the pivot pins 111 of one base panel 1 to the pivot holes 1121 in the cylindrical blocks 112 of the other base panel 1. Thus, these 2 pcs of base panels 1 are assembled together to provide a hexagonal plane. Thereafter, pivotally couple the first coupling structures 21 of 2 pcs of peripheral panels 2 to the second connection structures 12 of the two assembled base panels 1 by inserting the cylindrical coupling blocks 211 of the first coupling structures 21 of 2 pcs of peripheral panels 2 into the respective recessed holes 121 of the second connection structures 12 of the two assembled base panels 1 to pivotally couple the pivot pins 1211 of the second connection structures 12 of the two assembled base panels 1 to the respective coupling holes 2111 in the cylindrical coupling blocks 211 of the first coupling structures 21 of 2 pcs of peripheral panels 2.

Thereafter, pivotally couple the other 4 pcs of peripheral panels 2 and the 2 pcs of peripheral panels 2 at the two assembled base panels 1 together by: inserting the cylindrical mounting blocks 222 of one second coupling structure 2 of one peripheral panel 2 into the respective mounting grooves 221 of one second coupling structure 2 of another peripheral panel 2 to have the pivot pins 2221 of one peripheral panel 2 be respectively pivotally coupled to the respective knuckles 2211 of another peripheral panel 2. When these 6 pcs of peripheral panels 2 are assembled, the cylindrical coupling blocks 211 of the first coupling structures 21 of the peripheral panels 2 that are not pivotally coupled to the second connection structures 12 of the base panels 1 are respectively engaged into the locating notches 13 of the base panels 1. Thus, these 2 pcs of base panels 1 and 6 pcs of peripheral panels 2 are assembled to form a hexagonal combination storage box. The modularized design of the base panels 1 and peripheral panels 2 facilitates quick mass production and quality control, simplifies the assembly process, and saves much the installation time and labor costs As stated above, the first connection structure 11 at the longer parallel side of a first piece of base panel 1 can be pivotally coupled to the first connection structure 11 at the longer parallel side of a second piece of base panel 1; the first coupling structure 21 of one peripheral panel 2 can be pivotally coupled to the second connection structure 12 at the shorter parallel side of each base panel 1; one second coupling structure 22 of one peripheral panel 2 can be pivotally coupled to the other second coupling structure 22 of another peripheral panel 2. However, it is to be understood that the pivot connection design between each two component parts of the present invention can be variously embodied but not limited to what has been shown in the drawbacks.

Figure 5:
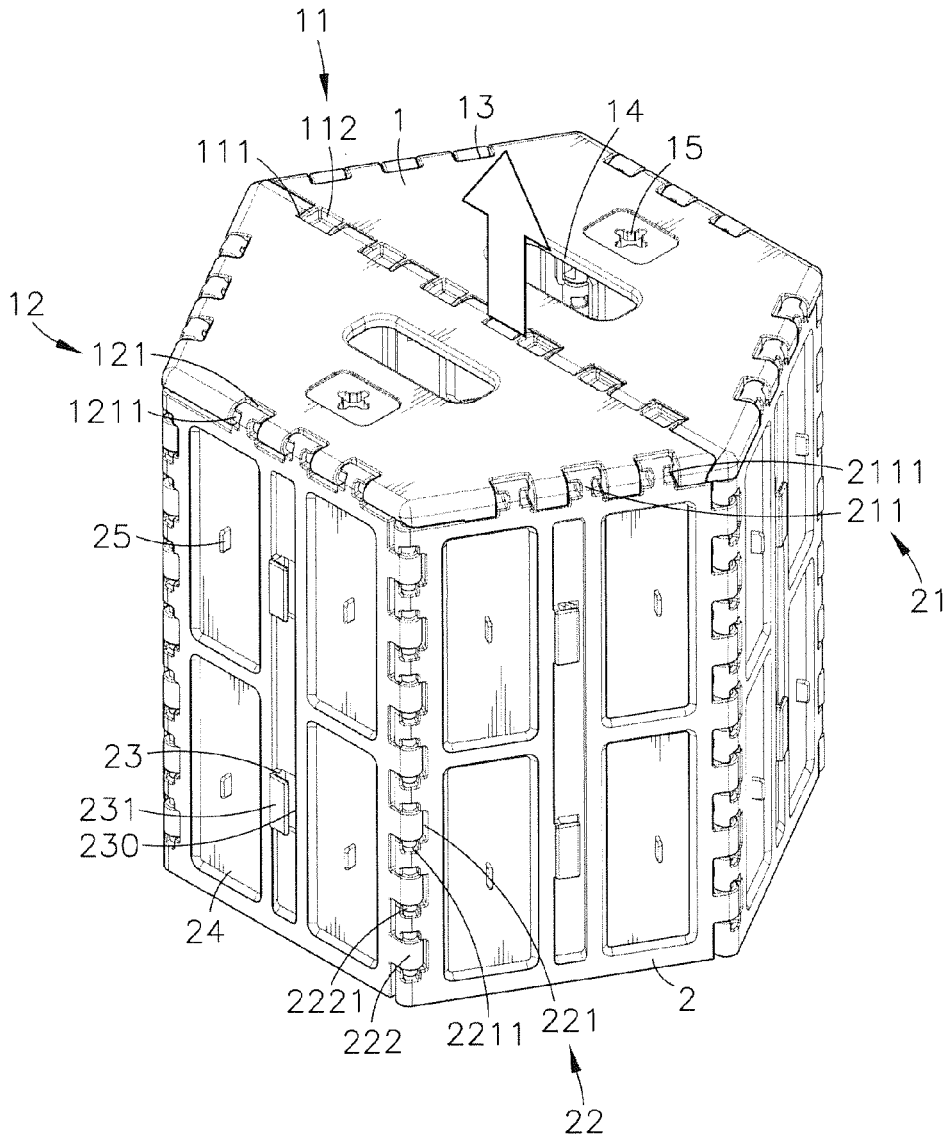
FIG. 5 is an oblique top elevational view of the present invention, illustrating the assembled hexagonal combination storage box positioned upside down.
Figure 6:
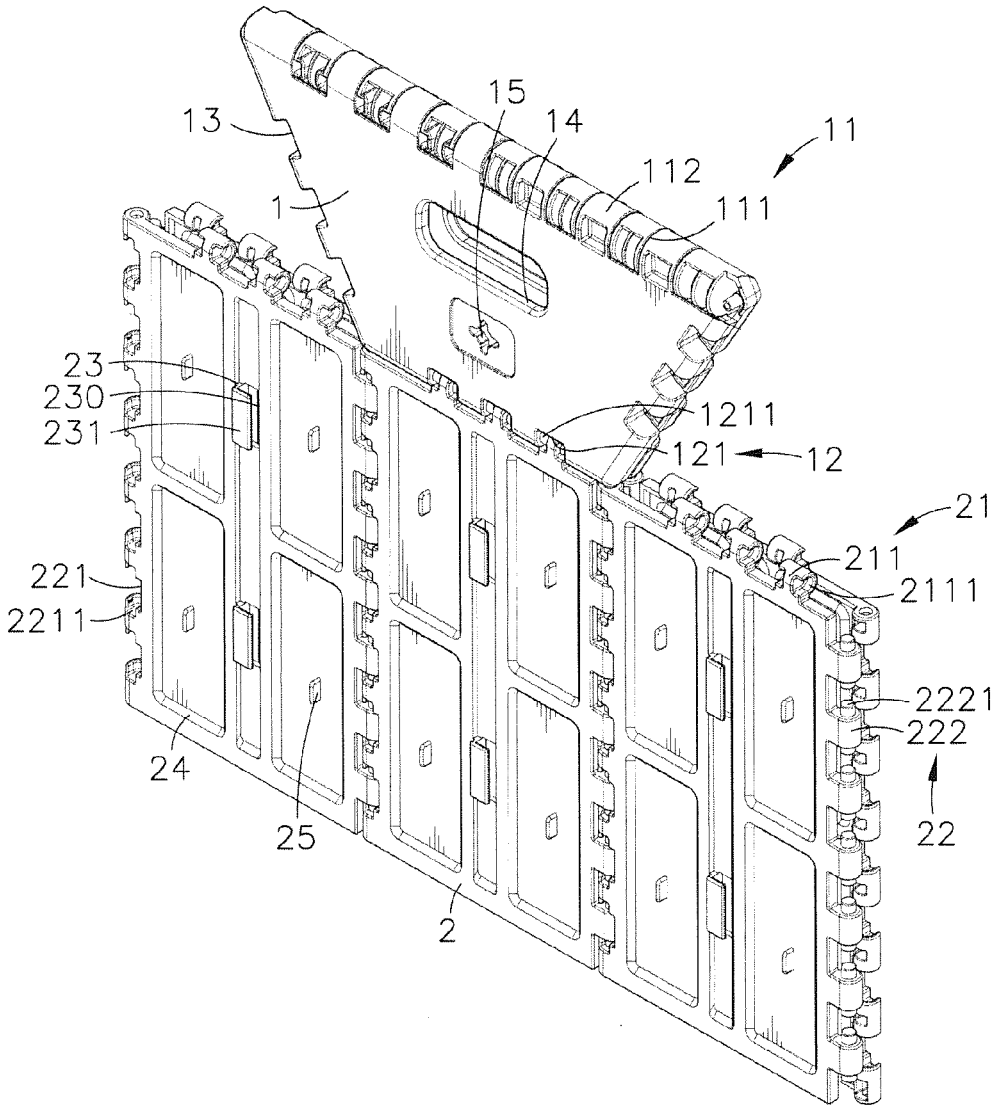
FIG. 6 illustrates a collapsed status of one assembled hexagonal combination storage box in accordance with the present invention.
Figure 7:
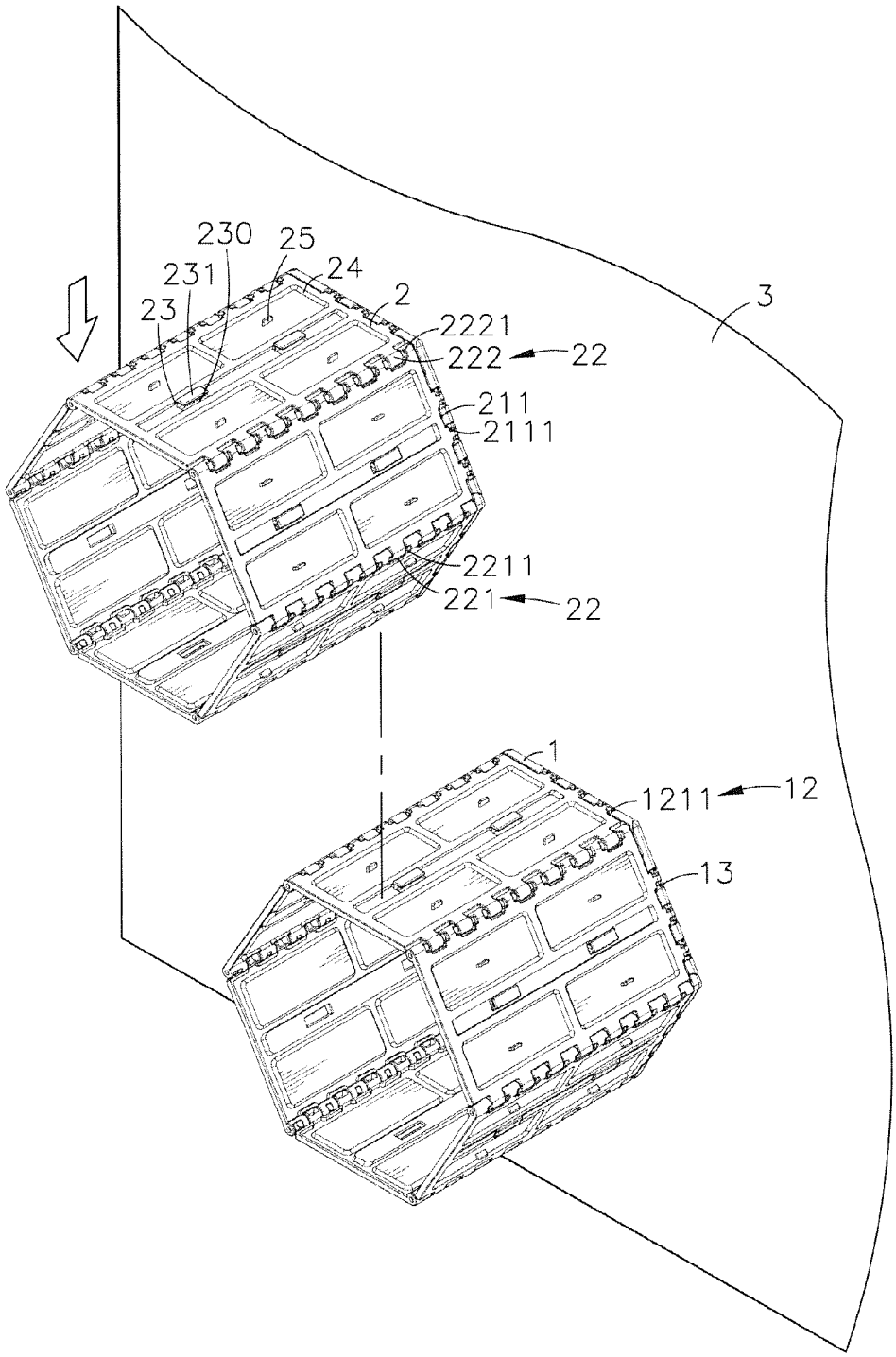
FIG. 7 is a schematic applied view of the present invention, illustrating one first assembled hexagonal combination storage box fastened to an upright wall before connection of a second assembled hexagonal combination storage box to the first assembled hexagonal combination storage box.
Figure 8:
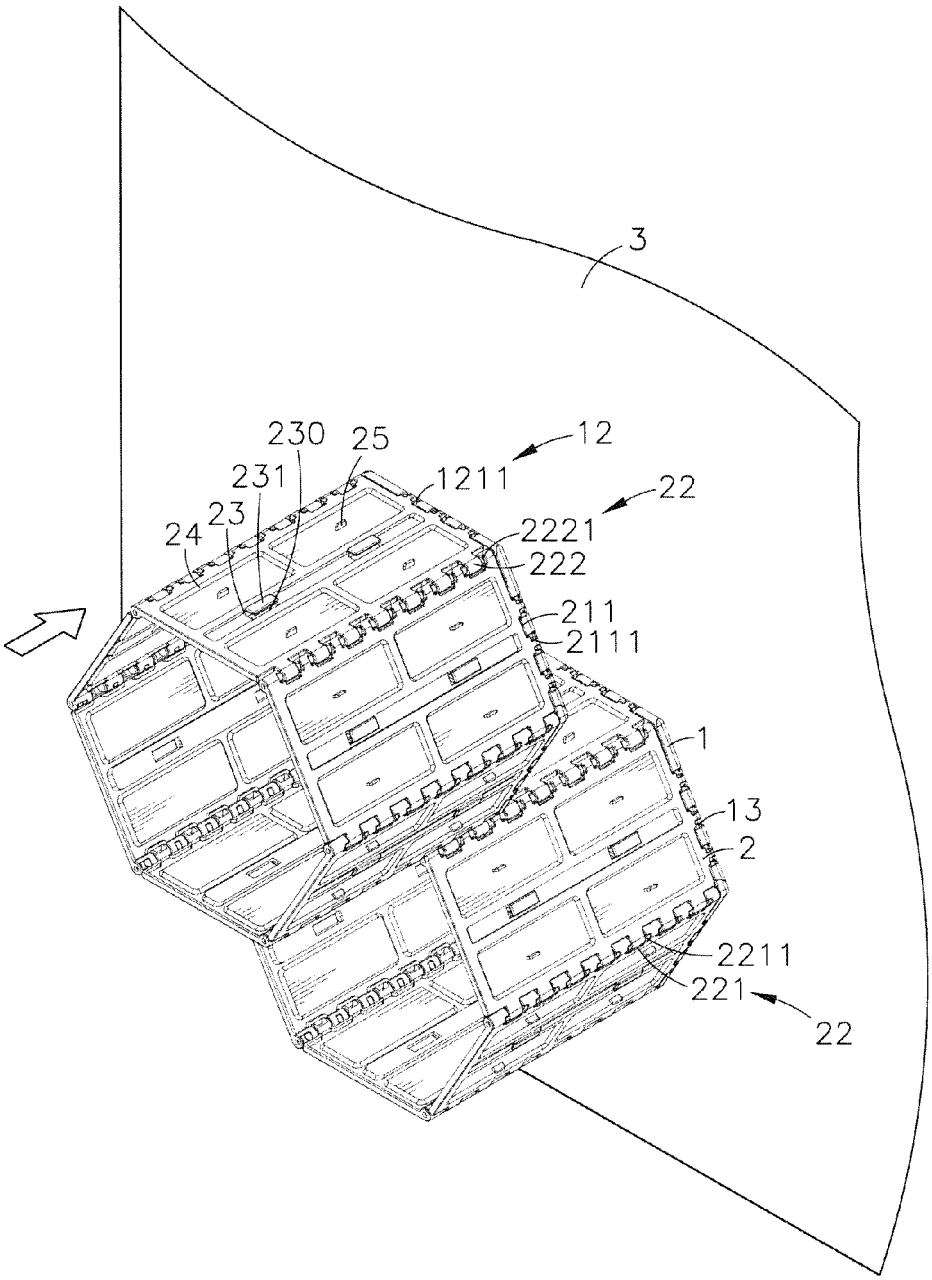
FIG. 8 corresponds to FIG. 7, illustrating the second assembled hexagonal combination storage box attached to the first assembled hexagonal combination storage box.
Figure 9:
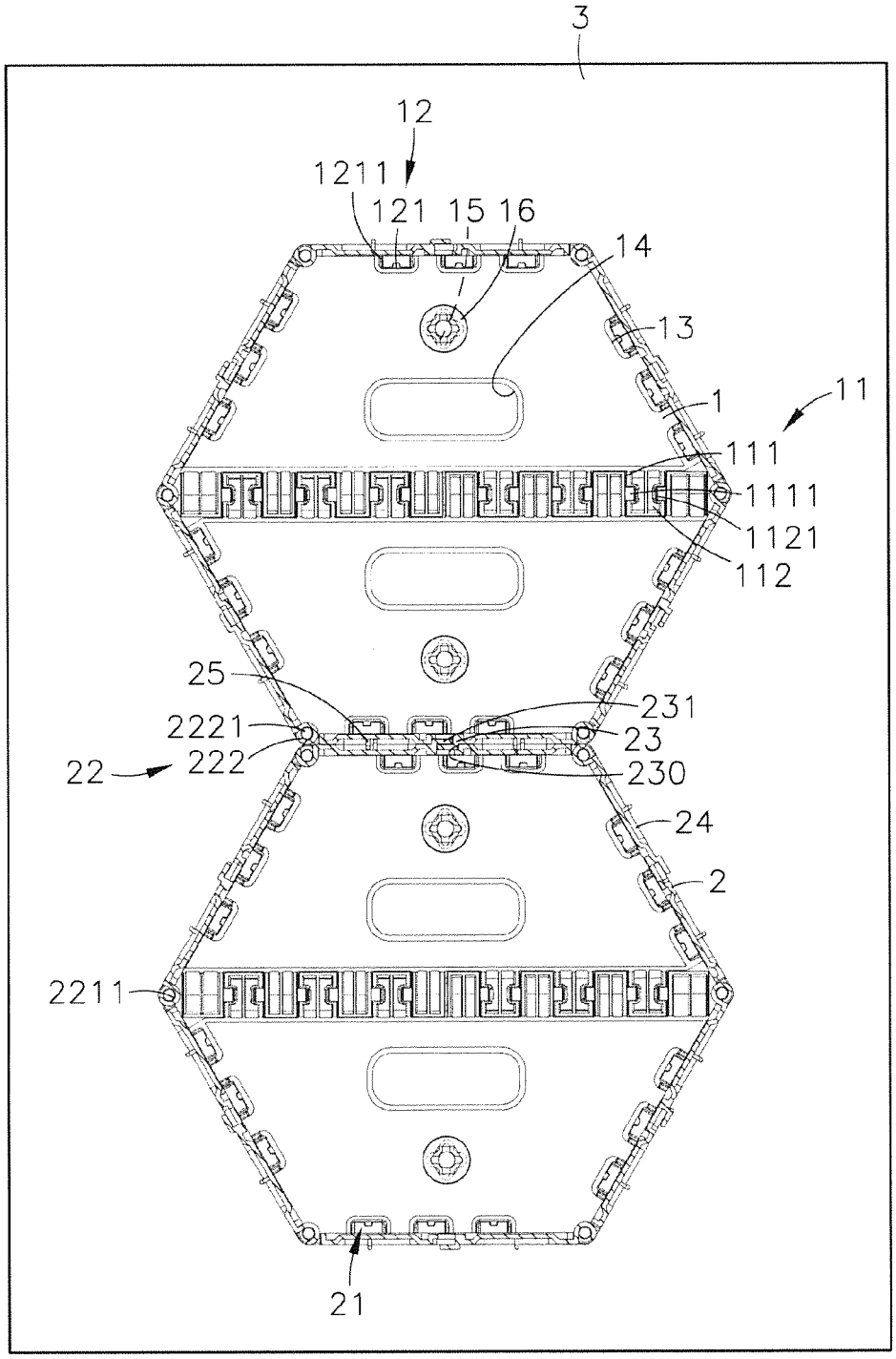
FIG. 9 is a sectional front view of FIG. 8.

Referring to FIGS. 5 and 6, the invention allows the assembled hexagonal combination storage box to be conveniently collapsed into a flat condition by inserting the hands into the hand holes 14 of the two base panels 1 and then lifting the two base panels 1 to let the two base panels 1 be turned toward each other. Subject to the coupling function between the second connection structures 12 of the base panels 1 and the first coupling structures 21 of the respective peripheral panels 2 and the coupling function between the second coupling structure 22 of one peripheral panel 2 and the other second coupling structure 22 of another peripheral panel 2, the 2 pcs of base panels 1 and the 6 pcs of peripheral panels 2 are collapsed, facilitating delivery and storage.

Figure 10:
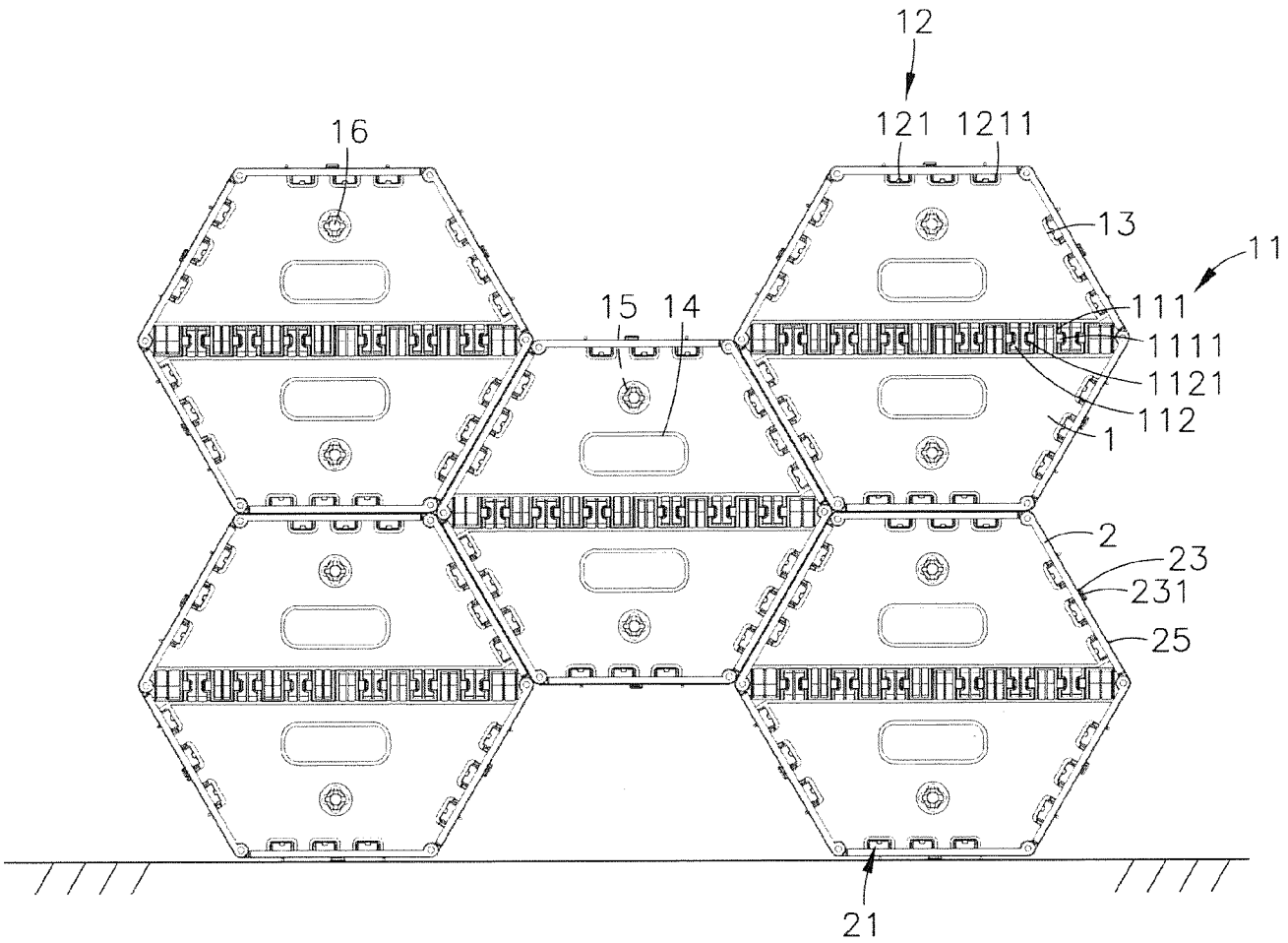
FIG. 10 is a schematic sectional front view illustrating multiple assembled hexagonal combination storage boxes arranged together.

Referring to FIGS. 7-10, a screw, expansion screw, locating pin or any other fastening member 16 can be mounted in the mounting through hole 15 of each base panel 1 to affix the assembled hexagonal combination storage box to an upright wall, wall panel or any other frame structure 3 (see FIG. 10). Further, when placing one assembled hexagonal combination storage box horizontally on the floor, the angled hook plates 231 of the hook structure 23 of one peripheral panel 2 and the respective lugs 25 can be stopped at the floor to support the hexagonal combination storage box above the floor, preventing moisture and water damage.

Further, multiple assembled hexagonal combination storage boxes can be horizontally attached together by moving the angled hook plates 231 of one peripheral panel 2 of one assembled hexagonal combination storage box into engagement with the angled hook plates 231 of one peripheral panel 2 of another assembled hexagonal combination storage box. Further, the lugs 25 in the recessed portions 24 of each peripheral panel 2 are so arranged that when multiple assembled hexagonal combination storage boxes are horizontally attached together to have the angled hook plates 231 of one peripheral panel 2 of one assembled hexagonal combination storage box be hooked up with the angled hook plates 231 of one peripheral panel 2 of another assembled hexagonal combination storage box, the lugs 25 in the recessed portions 24 of the respective peripheral panel 2 of one assembled hexagonal combination storage box are respectively abutted against the lugs 25 in the recessed portions 24 of the respective peripheral panel 2 of another assembled hexagonal combination storage box, enhancing the connection stability of the assembled hexagonal combination storage boxes. Thus, multiple assembled hexagonal combination storage boxes can be connected together to form a combination honeycomb storage box assembly.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A hexagonal combination storage box, comprising:

two pieces of base panels pivotally coupled together, said base panels being trapezoidal panels with two parallel sides of different lengths and two non-parallel lateral sides of equal length, each said base panel comprising a first connection structure located at the longer parallel side thereof and a second connection structure located at the shorter parallel side thereof, the first connection structure of one said base panel being pivotally connectable to the first connection structure of the other said base panel; and six pieces of peripheral panels pivotally coupled to one another and pivotally coupled to the second connection structures of said base panels, said peripheral panels being rectangular panels with two parallel short sides and two parallel long sides, each said peripheral panel comprising opposing front and back surfaces, a first coupling structure located at one short side thereof and pivotally connectable to the second connection structure of one said base panel, two mating second coupling structures respectively located at the two parallel long sides thereof, a hook structure located on a middle part of the front surface thereof, at least one recessed portion located on the front surface thereof around said hook structure and at least one lug disposed in said at least one recessed portion, the two mating second coupling structures being so designed that one of the two mating second coupling structures of one said peripheral panel being pivotally connectable to the other of the two mating second coupling structures of another said peripheral panel.

2. The hexagonal combination storage box as claimed in claim 1, wherein said first connection structure at the longer parallel side of each said base panel comprises a plurality of cylindrical blocks and open spaces alternatively arranged along the length of the longer parallel side of the respective base panel, a pivot pin extended from each of selected said cylindrical blocks and suspending in one respective said open space and two pivot holes bilaterally formed in each of the other non-selected cylindrical blocks and axially aligned in line, the first connection structure of one said base panel being pivotally coupled to the first connection structure of the other said base panel by: inserting the cylindrical blocks of one said base panel into the open spaces of the other said base panel to pivotally couple the pivot pins of one said base panel to the pivot holes in the cylindrical blocks of the other said base panel.

3. The hexagonal combination storage box as claimed in claim 1, wherein said second connection structure of each said base panel comprises a plurality of recessed holes equally spaced along the shorter parallel side of the respective base panel and two pivot pins disposed in each said recessed hole at two opposite sides and axially aligned in line; said first coupling structure of each said peripheral panel comprises a plurality of equally spaced cylindrical coupling blocks respectively insertable into the recessed holes of the second connection structure of one said base panel, and two coupling holes bilaterally defined in each said cylindrical coupling block and respectively pivotally coupled to the two pivot pins in each respective said recessed hole of the second connection structure of the respective said base panel.

4. The hexagonal combination storage box as claimed in claim 1, wherein each said base panel further comprises a hand hole cut through opposing top and bottom surfaces thereof and disposed adjacent to the first connection structure thereof.

5. The hexagonal combination storage box as claimed in claim 1, wherein each said base panel further comprises a mounting through hole cut through opposing top and bottom surface thereof for the mounting of a fastening member to affix the respective said base panel to a wall.

6. The hexagonal combination storage box as claimed in claim 1, wherein one second coupling structure of each said peripheral panel comprises a plurality of knuckles and a plurality of mounting grooves alternatively arranged along the length of the respective long side of the respective said peripheral panel; the other second coupling structure of each said peripheral panel comprises a plurality of cylindrical mounting blocks respectively insertable into the mounting grooves of one second coupling structure of another said peripheral panel, and two pivot pins respectively and axially extended from two opposite ends of each said cylindrical mounting block and respectively pivotally coupled to respective knuckles of one said second coupling structure of another said peripheral panel.

7. The hexagonal combination storage box as claimed in claim 1, wherein the hook structure of each said peripheral panel comprises two locating holes cut through the opposing front and back surfaces thereof and longitudinally spaced on the middle part thereof and two angled hook plates respectively disposed adjacent to said locating holes.

8. The hexagonal combination storage box as claimed in claim 1, wherein each said peripheral panel comprises four recessed portions located on the front surface thereof and respectively disposed at two opposite lateral sides relative to said hook structure, and a lug respectively located on each said recessed portion, the lugs of each said peripheral panel being so arranged that one lug of one said peripheral panel being abutted against one respective lug of another said peripheral panel when two said peripheral panels are arranged in a stack.

* * * * *